US010971831B2

(12) United States Patent
Froeschl

(10) Patent No.: US 10,971,831 B2
(45) Date of Patent: Apr. 6, 2021

(54) CONTACT SYSTEM

(71) Applicant: Gebauer & Griller Kabelwerke Gesellschaft m.b.H., Poysdorf (AT)

(72) Inventor: Karl Froeschl, Herrnbaumgarten (AT)

(73) Assignee: Gebauer & Griller Kabelwerke, Poysdorf (AT)

( * ) Notice: Subject to any disclaimer, the term of this patent is extended or adjusted under 35 U.S.C. 154(b) by 753 days.

(21) Appl. No.: 15/502,556

(22) PCT Filed: Jul. 14, 2015

(86) PCT No.: PCT/AT2015/050165
§ 371 (c)(1),
(2) Date: Feb. 8, 2017

(87) PCT Pub. No.: WO2016/023052
PCT Pub. Date: Feb. 18, 2016

(65) Prior Publication Data

US 2017/0229794 A1 Aug. 10, 2017

(30) Foreign Application Priority Data

Aug. 12, 2014 (AT) ..... A 50567/2014

(51) Int. Cl.

| | |
|---|---|
| ***H01R 4/50*** | (2006.01) |
| ***H01R 4/62*** | (2006.01) |
| ***H01R 11/12*** | (2006.01) |
| ***H01R 43/02*** | (2006.01) |
| ***H01R 43/04*** | (2006.01) |

(52) U.S. Cl.
CPC ..... *H01R 4/5083* (2013.01); *H01R 4/62* (2013.01); *H01R 4/625* (2013.01); *H01R 11/12* (2013.01);
(Continued)

(58) Field of Classification Search
CPC ..... H01R 4/5083; H01R 4/62; H01R 4/625; H01R 11/12; H01R 43/0207; H01R 43/04; H01R 2201/26
(Continued)

(56) References Cited

U.S. PATENT DOCUMENTS 2,374,324 A 4/1945 Blough et al.
3,249,908 A * 5/1966 Fuller ..... H01R 4/2491 439/393
(Continued)

FOREIGN PATENT DOCUMENTS

CN 2807505 Y 8/2006
DE 8312497 U1 9/1983
(Continued)

OTHER PUBLICATIONS

Chinese Language Office Action for application No. 201580042945.2. 7 pages, dated Apr. 24, 2019.
(Continued)

*Primary Examiner* — Peter Dungba Vo
*Assistant Examiner* — Azm A Parvez
(74) *Attorney, Agent, or Firm* — McKee, Voorhees & Sease, PLC

(57) ABSTRACT

Contact system for producing an electrically conductive contact between an aluminum conductor (3) and a contact component (2). A housing (1) is provided, as well as a contact component (2) having a shearing-off section (13) and a tapered compression segment (14), where the housing (1) has an insertion volume (4) for the aluminum conductor (3) and an insertion volume (5) for the contact component (2) and the two insertion volumes (4, 5) overlap within the housing (1) and form a common overlapping volume (8) so as to enable, when the aluminum conductor (3) has been pushed into the insertion volume (4), for the aluminum
(Continued)

conductor (3), the severing/shearing-off and cold welding of the aluminum conductor (3) with the contact component (2) by means of the contact component (2).

18 Claims, 5 Drawing Sheets

(52) U.S. Cl.
CPC ..... *H01R 43/0207* (2013.01); *H01R 43/04* (2013.01); *H01R 2201/26* (2013.01)

(58) Field of Classification Search
USPC ..... 29/861, 857, 825, 592.1
See application file for complete search history.

(56) References Cited

U.S. PATENT DOCUMENTS 3,707,698 A * 12/1972 Robinson ..... H01R 4/308 439/431
4,098,449 A * 7/1978 Noesen ..... B23K 20/2333 228/115
5,292,263 A * 3/1994 Mosser, III ..... H01R 4/308 439/812
5,890,684 A * 4/1999 Stewart ..... F16L 3/23 248/68.1

FOREIGN PATENT DOCUMENTS

WO 9613877 A1 5/1996
WO 9931762 A1 6/1999

OTHER PUBLICATIONS

English Translation of Chinese Office Action for application No. 201580042945.2, 10 pages, dated Apr. 24, 2019.
Gebauer & Griller Kabelwerke Gesslschaft m.b.H., PCT/AT2015/050165, "The International Search Report and the Written Opinion of the International Searching Authority, or the Declaration" dated Aug. 12, 2014.
Search Report dated Jun. 9, 2015 in AT Application No. 50567/2014, filed Aug. 12, 2014.

* cited by examiner

CONTACT SYSTEM

CROSS REFERENCE TO RELATED APPLICATIONS

This is a national phase of PCT/AT2015/050165, filed Jul. 14, 2015 and claims priority to Austrian Application No. A50567/2014, filed on Aug. 12, 2014.

FIELD OF INVENTION

This present invention concerns a contact system for formation of an electrically conductive contact between an aluminum conductor and a contact component, where the term aluminum conductor in this case is used both for conductors of pure aluminum and for conductors of aluminum alloys.

PRIOR ART

It is known that aluminum tends to flow under very high pressure and because of that can become cold-welded to contacting materials. Such a connection is inseparable and electrically conductive. Moreover, it is conventional in particular in the automotive industry, but in other fields as well, to use electrical conductors of a lightweight metal, for example aluminum or aluminum alloys, which are usually bonded in an electrically conductive way to contacts made of more noble metals such as copper. Because of the dynamic stresses that continuously arise over many years in automobile construction, there are particular requirements on the quality of the electrically conductive connections.

Making such connections is difficult in particular in the region of oxide layers present on the surface of aluminum alloys. For this reason the compression process that produces the cold weld in practice is frequently supported by friction welding processes such as ultrasound welding processes or rotary friction welding processes. Without such support by additional friction welding processes, a cold weld that is continuous over the entire cross section can often not be achieved especially in the case of aluminum conductors that have larger cross sections. Because of this, the formation of such an electrically conductive connection between an aluminum conductor and a contact component is dependent on the presence of costly welding units, which moreover are not portable and for this reason cannot be used flexibly.

A clamp for an axial connection of an electric conductor 3 is known from DE 8312497 U1. The conductor is inserted into a body that forms a cage along one wall of the body. A movable sliding block is moved at an angle against the wall by means of a screw in order to press the conductor against the wall without a weld occurring.

A connection system for cables having a case and a wedge that can be inserted into the case is known from WO 99/31762 A1. The case has channel-shaped segments, in each of which a cable can be inserted. The wedge can be inserted in between the segments in order to press the cables against the case from inside without a weld occurring.

A terminal element for an electric conductor, which can be made from aluminum, for example, is known from U.S. Pat. No. 3,707,698 A. The terminal element comprises an opening without threads, into which the conductor can be inserted, and an additional threaded opening for a steel screw. With the conductor inserted, the steel screw presses the conductor against a wall of the opening when the steel screw is tightened. Furthermore, the thread of the steel screw cuts into the surface of the conductor when the steel screw is tightened.

A connector for a power cable, where the connector comprises a clamp element with a C-shaped cross section in which a conductor is disposed, is known from WO 96/13877 A1. The conductor is securely clamped with a clamping wedge which is likewise inserted into the C-shaped cross section by one edge. Further connection to a cable takes place by means of a terminal flange of the clamping wedge, where an end piece of the cable is screwed to the terminal flange.

A clamp for a ground cable for welding machines, where the clamp comprises a block in which a boring with a conical inlet segment and a cylindrical accommodation segment is disposed to hold the (stripped) ground cable, is known from U.S. Pat. No. 2,374,324 A. The accommodation segment ends in a tapered opening running perpendicular to it, which serves to hold a wear plate and a wedge. The end of the ground cable projecting into the opening is bent around when it contacts the wear plate, pressed against the wall of the opening, and clamped.

Problem of the Invention

It is therefore the problem of this invention to propose a contact system for producing an electrically conductive contact between an aluminum conductor and a contact component, which on the one hand is capable of making a continuous cold weld connection regardless of the thickness of the cross section of the aluminum conductor and on the other hand does without additional welding processes, for example friction welding processes.

NATURE OF THE INVENTION

According to the invention, this is achieved in that the contact system comprises a housing and a contact component having a shearing-off segment and a tapered compression segment and the housing has an insertion volume for the aluminum conductor and an insertion volume for the contact component and the two insertion volumes overlap within the housing and in this way form a common overlapping volume in order to enable the severing/shearing-off of the aluminum conductor and its cold welding to the contact component by means of the contact component when the aluminum conductor is pushed into the insertion volume for the aluminum conductor.

It turned out that the use of such a contact system in accordance with the invention makes additional friction welding processes and thus high-tech welding installations obsolete. Because of the shearing-off segment of the contact component, the aluminum conductor can be severed/sheared off at a defined point, so that an oxide- and oil-free cut surface is created. The tapered compression segment of the contact component serves to press the unseparated segment of the aluminum conductor against a part of the boundary wall of the inner volume of the housing and to compress this segment so that a cold weld arises between the now oil- and oxide-free cut surface of the aluminum conductor and the contact component.

The formation of such connections requires only the use of a hydraulic unit in order to enable the feed of the contact component into the insertion volume of the contact component and to be able to apply the force needed for the cold weld. As a rule, such hydraulic units are robust, easy to operate, and, in contrast to high-tech welding units, are commonly found, as a rule in the average equipped car repair shop and, in each case according to size, are often even portable and thus flexibly usable.

In order to facilitate guiding the aluminum conductor and the contact component in the housing, in a preferred variation of the invention it is provided that the insertion volume in the housing be made in the form of a channel.

Preferably, the channel-shaped insertion volume for the aluminum conductor has a cross section that corresponds in shape to the cross section of the aluminum conductor that is to be accommodated and the channel-shaped insertion volume for the contact component has a cross section that corresponds in shape to the cross section of the contact component that is to be accommodated. Due to the matching of the shape of the cross sections to each other, the possibility for guiding the aluminum conductor and the contact component in the housing can be improved further, so that in this way the possibility for installing the housing in a setting, for example in a vehicle, can also be made more flexible.

In an especially preferred embodiment of the invention, it is provided that the overlapping volumes end in an exit opening that leads out of the housing. In this way the severed segment of the aluminum conductor can be removed from the housing.

It is provided in another preferred embodiment that the lengthwise axis of the channel-shaped insertion volume for the aluminum conductor and the lengthwise axis of the channel-shaped insertion volume for the contact component enclose an acute insertion angle. In an especially preferred embodiment, this angle is between 1° and 70°, preferably between 1° and 45°. The angled positioning supports the compression process that brings about the cold weld and increases the cut surface area of the aluminum conductor that arises in the severing/shearing-off of it. The acute angle in any case is [sic; can be] smaller than noted above in each case according to the materials/alloys of the aluminum conductor and the contact component that are used.

It is provided according to an especially preferred embodiment of the invention that the channel-shaped insertion volume for the aluminum conductor have a round or rectangular cross section and/or that the channel-shaped insertion volume for the contact component have a rectangular cross section. This guarantees optimal compression of the aluminum conductor over the entire cross-sectional width of the contact component.

It is provided in another embodiment of the invention that the contact component have a first segment that is made rectangular in the longitudinal section and a segment, preferably immediately adjacent to the first segment, which is made tapered in the lengthwise section so that the severing/shearing-off of the aluminum conductor can be undertaken by the first segment, in particular by the shearing-off segment formed there, and, with appropriate dimensioning, the compression and thus cold welding by the second segment can take place only after complete severing/shearing-off of the aluminum conductor.

It is provided according to an especially preferred embodiment of the invention that the contact component have means for contacting via a terminal element, preferably a boring. In this case the contact component serves not only for severing/shearing-off and compression of the aluminum conductor, but also as contact element for direct contacting via a terminal element for the relevant use.

Especially preferably, said means are disposed for contacting at the first segment of the contact component.

It is provided according to another embodiment of the invention that in a cold-welded state of aluminum conductor and contact component, the contacting means projects from the housing, preferably from the exit opening. In this case the exit opening can be used not only to remove the severed/sheared segment of the aluminum conductor, but also serves for contacting via a terminal element.

To optimize the cold welding properties, the housing in a preferred embodiment of the invention is made of aluminum or an aluminum alloy or copper alloy with a nickel surface, and/or the contact component is made of copper or a copper alloy with a nickel surface.

According to another preferred embodiment, the aluminum conductor is made as a stranded conductor, so that in the course of the cold welding process, the strands also become cold-welded to each other.

The problem underlying the invention is also solved by a method for producing a cold weld between an aluminum conductor and a contact component by means of the described contact system, said method consisting of the following steps:

- insertion of an aluminum conductor that has been stripped or not stripped in its end region into an insertion volume of the housing for the aluminum conductor
- pushing the aluminum conductor in the insertion volume for the aluminum conductor until a cross section of the aluminum conductor is completely situated in the overlapping volume
- insertion of a contact component into the insertion volume of the housing for the contact component
- pushing the contact component in the insertion volume for the contact component until the contact component contacts the aluminum conductor
- pushing the contact component further and severing/shearing-off the segment of the aluminum conductor that is in the overlapping volume in front of the contact component
- pushing the contact component further and pressing the aluminum conductor against a boundary wall bounding the insertion volume for the aluminum conductor, to produce the cold weld between the aluminum conductor and contact component.

According to a preferred embodiment of the method according to the invention, the contact component is forced into the feed direction with a force between 5 N and 500 kN, especially preferably with a force between 0.5 kN and 500 kN, to produce the cold weld.

Another preferred embodiment of the invention calls for the severed/sheared segment of the aluminum conductor to be pushed out from the housing via the exit opening.

BRIEF DESCRIPTION OF THE FIGURES

The invention will now be explained in more detail by means of embodiment examples. The drawings are exemplary and are intended to represent the idea of the invention but not to limit it in any way or to reproduce it in a final form.

Here.

WAYS TO IMPLEMENT THE INVENTION

Figure 1:
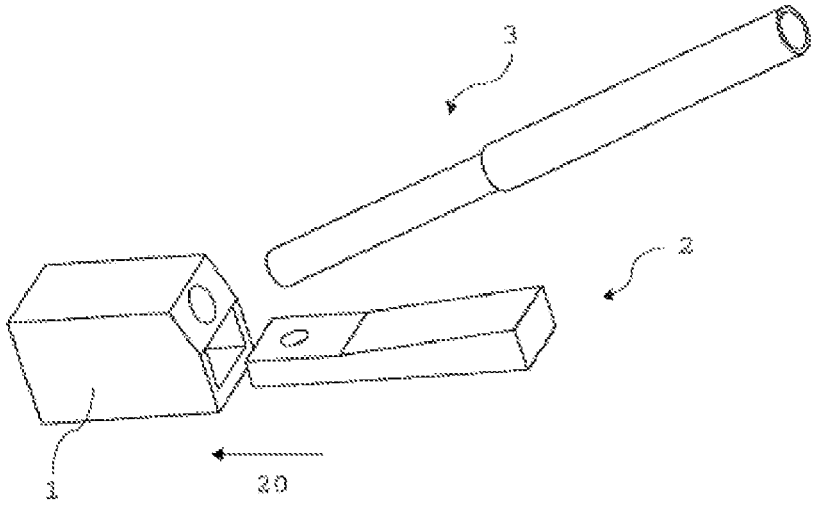
FIG. 1 shows an axonometric view of a contact system according to the invention before the insertion of the aluminum conductor and the contact component into the housing.

FIG. 1 shows an axonometric view of a contact system according to the invention consisting of a housing 1, for example, consisting of aluminum or an aluminum alloy or of a copper alloy with nickel surface, and a contact component 2, which preferably consists of copper or a copper alloy with nickel surface. Moreover, in FIG. 1 one can see a, not necessarily stripped, aluminum conductor 3 with round cross section which is preferably made as a stranded aluminum conductor and is intended to be cold-welded to the contact component 2.

Figure 2:
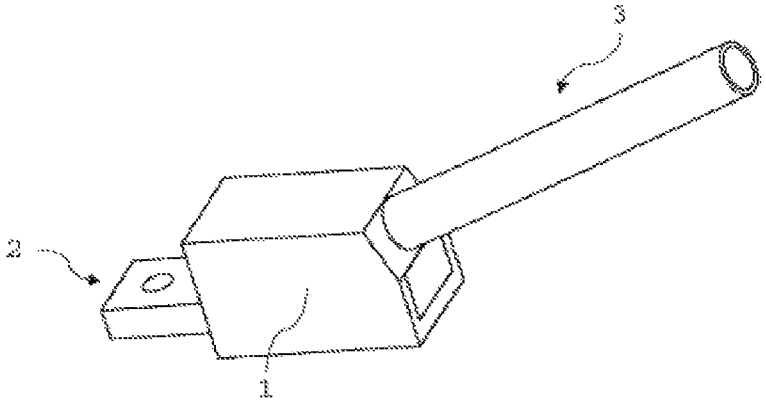
FIG. 2 shows an axonometric view of a contact system according to the invention with cold-welded aluminum conductor and contact component.

FIG. 2 shows the same contact system, but with the aluminum conductor 3 and contact component 2 already cold-welded.

FIGS. 3 to 7 show details concerning the formation of the cold weld between aluminum conductor 3 and contact component 2.

Figure 3:
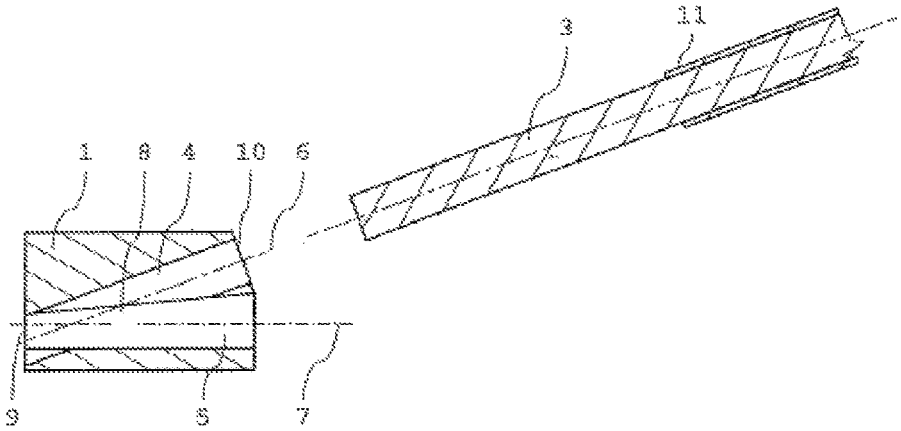
FIG. 3 to FIG. 7 show a representation of the method for making the cold weld between the aluminum conductor with a round cross section and the contact component.

For this purpose, as can be seen in FIG. 3, the housing 1 is made with a channel-shaped insertion volume 4 for the aluminum conductor 3 and a channel-shaped insertion volume 5 for the contact component 2. The channel-shaped design of the insertion volumes 4 and 5 enables the guiding of the aluminum conductor 3 and contact component 2 in housing 1. The channel-shaped insertion volume 4 for the aluminum conductor 3 has a lengthwise axis 6, while the channel-shaped insertion volume 5 for the contact component 2 has a lengthwise axis 7. The two lengthwise axes enclose an acute insertion angle 18, which is preferably between 1° and 70°, especially preferably between 1° and 45°, and in any case is dependent on the cross section and material of the aluminum conductor 3 and the design of the shearing-off segment 3 (see below) of the contact component 2.

The two insertion volumes 4 and 5 overlap in housing 1, so that an overlapping volume 8 is formed, which in this embodiment example ends in an exit opening 9 that leads out of the housing 1. Preferably, the surface of the housing 1 in the region of an insertion opening 10 of the insertion volume 4 is made normal to the lengthwise axis 6 in order to facilitate the insertion of the aluminum conductor 3.

Figure 4:
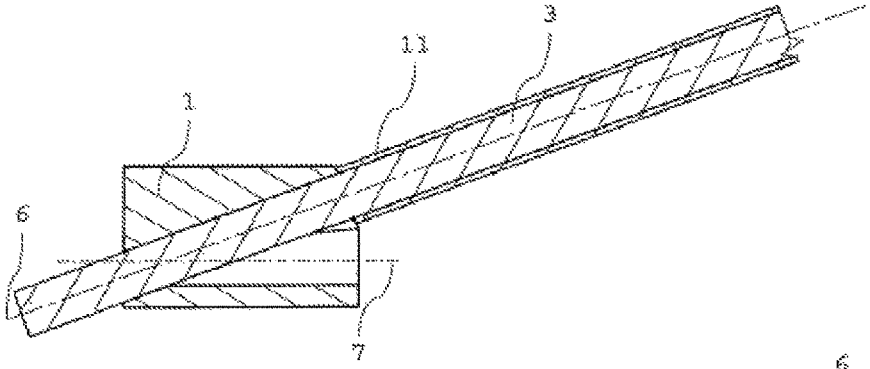

FIG. 4 shows the contact system according to the invention with the aluminum conductor 3 pushed into the insertion volume 4. The aluminum conductor 3 has been pushed into the insertion volume 4 so far that it projects from the housing 1 through the exit opening 9.

The described implementation of the surface of the housing 1 in the region of insertion opening 10 normal to the lengthwise axis 6 and the matching of the cross section of the insertion volume 4 to the cross section of the stripped segment of the aluminum conductor results, for a stripped aluminum conductor 3, in the ability to set the aluminum conductor 3 against the said surface with the insulation 11 and through this the depth to which the aluminum conductor 3 is pushed into the housing 1 can be specified exactly, so that in any case the conductor reliably projects into the overlapping volume 8 and in addition as shown, projects or does not project, as desired, from the housing 1.

For the sake of better understanding it should not be left unmentioned at this point that the cross section of the insertion volume 4 or 5 is understood to be the surface normal to the relevant lengthwise axis 6, 7 and "lengthwise section' is understood to mean the cut surface through or parallel to said lengthwise axis or axes 6, 7.

Figure 5:
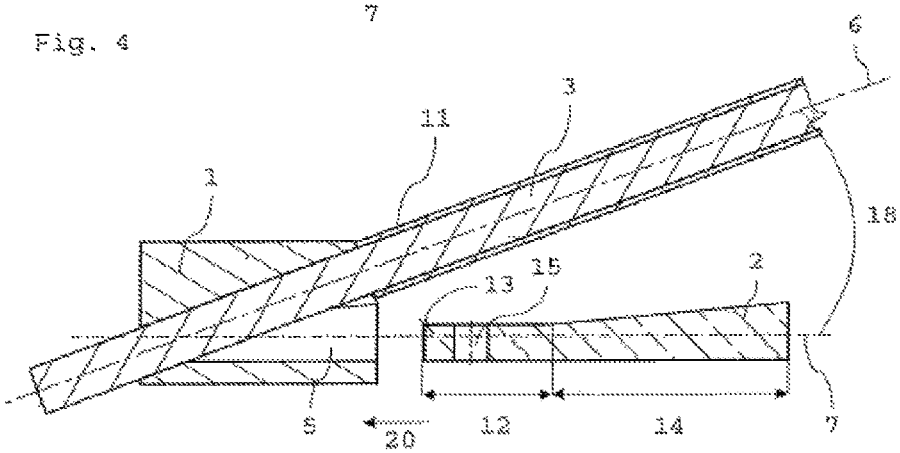

FIG. 5 corresponds to FIG. 4, but in this view the contact component 2 is also visible along with its feed direction, indicated by arrow 20, in which the contact component 2 is pushed into the insertion volume 5.

In this embodiment example the contact component 2 has a first segment 12, which in a lengthwise section is made rectangular with respect to the lengthwise axis 7 and forms a shearing-off segment 13 on its front face, which is turned toward the insertion volume 5 or the aluminum conductor 3. This shearing-off segment can be made as a shearing-off edge, which simplifies the process of severing/shearing-off of the aluminum conductor 3 and/or reduces the force needed for that. Moreover, in many cases it can also be advantageous if the shearing-off segment 13 is made rounded off or chamfered in order to achieve a less precise but larger cut surface 16 at the aluminum conductor 3.

Immediately next to the first segment 12 is a second segment 14, which is made tapered in a lengthwise section. In this embodiment example, in the first segment there are also means 15 for contacting the contact component 2 through a terminal element (not shown), where in this case the means is a connection boring.

Figure 6:
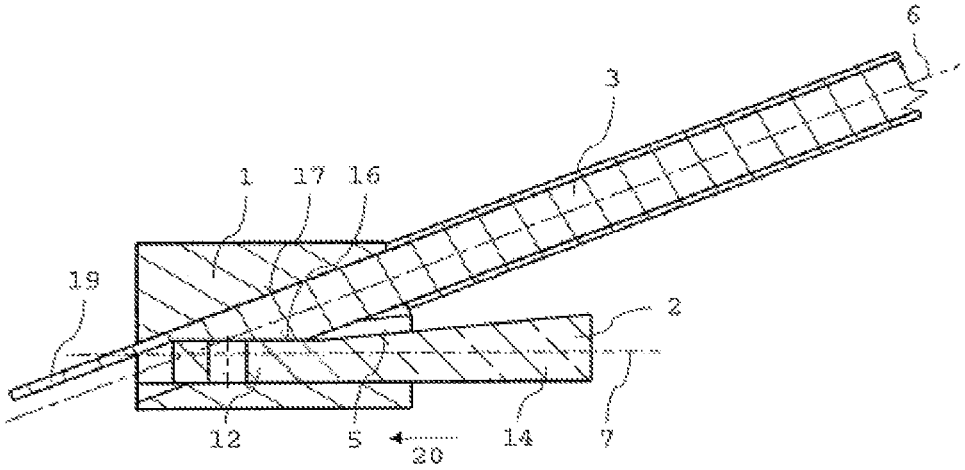
Figure 7:
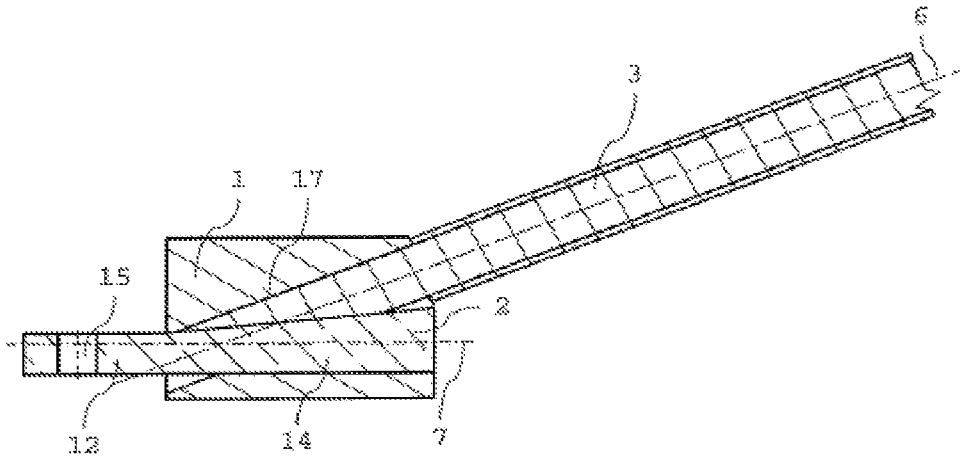
Figure 8:
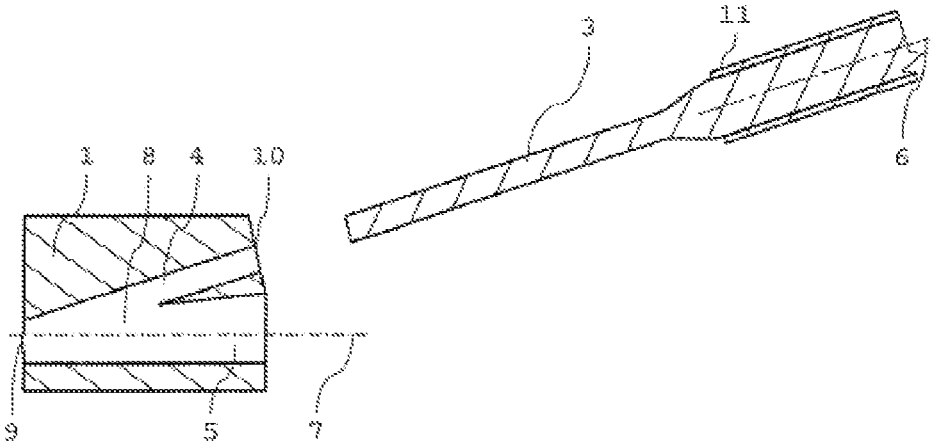
FIG. 8 to FIG. 12 shows a representation of the method for making the cold weld between the aluminum conductor with rectangular cross section and the contact component.
Figure 9:
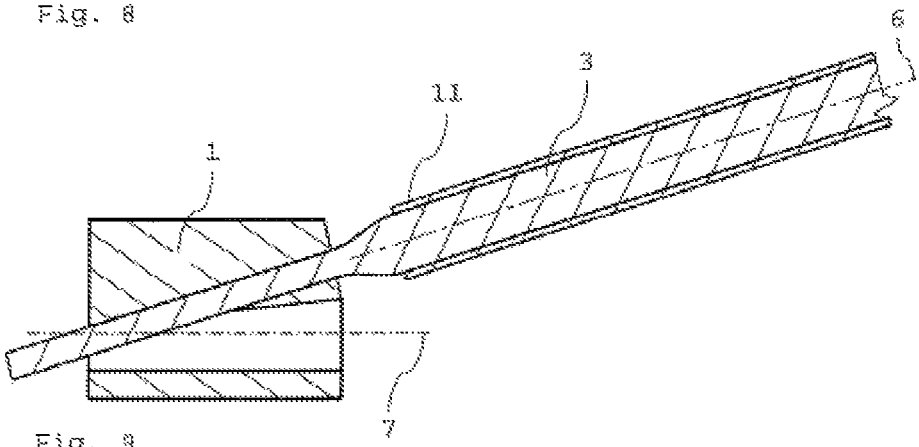
Figure 10:
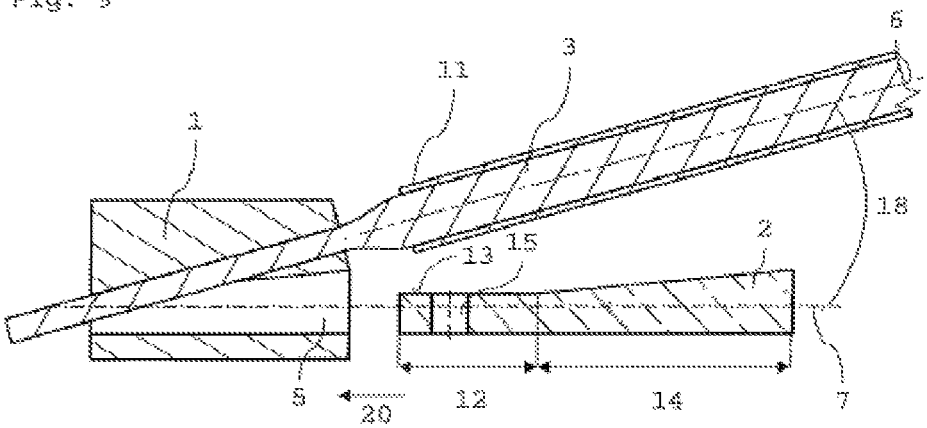
Figure 11:
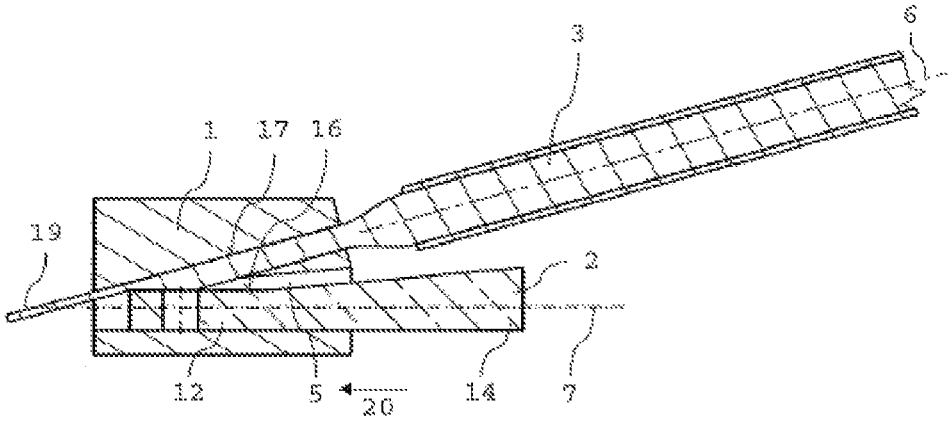
Figure 12:
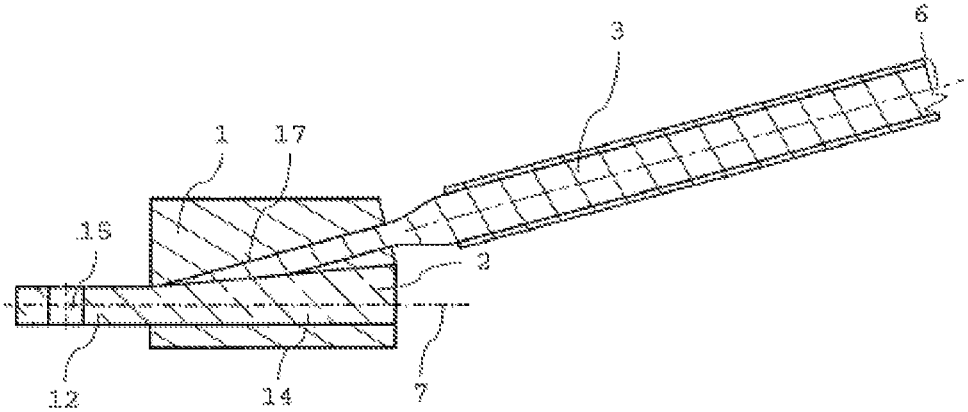

FIGS. 6 and 7 show the actual process of cold welding. First the contact component 2 with the shearing-off segment 13 is pushed forward into the insertion volume 5 provided for this. When the shearing-off segment 13 passes into the overlapping volume 8, shearing-off and thus severing of the aluminum conductor 3 begins, so that an oil- and oxide-free slanted cut surface 16 is created on aluminum conductor 3. The contact component 2 is then advanced into the insertion volume 5 until the aluminum conductor 3 is completely severed/sheared and the sheared segment 19 is pushed out of the housing 1 by the contact component 2 itself via the exit opening 9. In the course of pushing the contact component 2 in the insertion volume 5, the first segment 12 of the contact component comes out of engagement with the cut surface 16 of the aluminum conductor 3 and the second, tapered segment 14 becomes engaged with the cut surface 16 of the aluminum conductor 3, so that it presses against a boundary wall 17 that bounds the insertion volume 4 from above in FIGS. 6 and 7 and in this way makes the cold weld between the aluminum conductor 3 and the contact component 2. If the aluminum conductor 3 is made as a stranded conductor, the pressing also leads to a cold welding of the individual strands to each other.

In order to enable the advance of the contact component 2 in the insertion volume 5, a hydraulic device is necessary in most applications; depending on the conductor cross section and the insertion angle 18 of the aluminum conductor 3, the hydraulic device must be capable of applying up to 500 kN, preferably between 0.5 kN and 500 kN, possibly even more, in the feed direction 20. Only in the case of especially small conductor cross sections can the advance of the conductor component 2 take place merely by manual operation and still have a cold weld be formed between the contact component 2 and the aluminum conductor 3, so that in these cases the contact component 2 can also be forced in the feed direction 20 even with lower forces, starting with 5 N. The advance of the contact component 2 in the channel-shaped insertion volume 5 is determined by the geometry of the insertion volume 5 and the geometry of the contact component 2 itself, in particular by the transition between the first segment 12 of the contact component 2 and the second, tapered segment 14.

In the position of the contact component 2 shown in FIG. 7, the aluminum conductor 3 is already completely sheared and the sheared-off segment 19 of the aluminum conductor 3 has been completely removed from the housing 1. Contact component 2 and aluminum conductor 3 are pressed against each other and correspondingly cold-welded, so that the contact component 2 can no longer be removed from the insertion volume 5. Moreover, the means 15 for contacting project from the housing 5 so that a terminal element (not shown) can be affixed to it.

It goes without saying that one can conceive of embodiments in which the contact component 2 is disposed in a state welded to the aluminum conductor 3 completely within the housing 1 and that the housing 1 itself can be provided with means for contacting with various terminal elements. In this case it must be ensured that the housing 1 is likewise designed to be appropriately electrically conductive for the intended purpose.

FIGS. 8 to 12 essentially correspond to FIGS. 3 to 7, but with the difference that an aluminum conductor 3 with rectangular cross section is used instead of an aluminum conductor 3 with round cross section. Correspondingly, the insertion volume 4 in FIGS. 8 to 12 also has a rectangular cross section instead of a round one.

REFERENCE LIST

1 Housing
2 Contact component
3 Aluminum conductor
4 Insertion volume for aluminum conductor
5 Insertion volume for contact component
6 Lengthwise axis
7 Lengthwise axis
8 Overlapping volume
9 Exit opening
10 Insertion opening
11 Insulation
12 First segment of contact component
13 Shearing-off segment
14 Second segment of contact component
15 Means for contacting
16 Cut surface
17 Boundary wall
18 Angle between the two lengthwise axes
19 Sheared-off segment of aluminum conductor
20 Direction of advance of contact component

The invention claimed is:

1. A contact system for forming an electrically conductive contact between an aluminum conductor and a contact component, where the contact system comprises a housing and the contact component, the contact component having a shearing-off segment and the housing has an insertion volume for the aluminum conductor and an insertion volume for the contact component and the two insertion volumes overlap within the housing and in this way form a common overlapping volume such that, when the aluminum conductor is pushed into the insertion volume for the aluminum conductor until a cross section of the aluminum conductor is situated completely in the overlapping volume, a severing/shearing-off of a segment of the aluminum conductor that is in the overlapping volume in front of the contact component by the shearing-off segment of the contact component is produced when the contact component is at first pushed into the insertion volume for the contact component until the contact component contacts the aluminum conductor and is then pushed further, wherein the contact component has a tapered compression segment and wherein the overlapping volume is formed in such a way that, when the aluminum conductor is pushed into the insertion volume for the aluminum conductor until a cross section of the aluminum conductor is situated completely in the overlapping volume, a cold welding of the aluminum conductor to the contact component by the compression segment is produced when the contact component is pushed even further after being first pushed into the insertion volume for the contact component until the contact component contacts the aluminum conductor and then pushed further for the severing/shearing-off of the segment of the aluminum conductor.

2. The contact system as in claim 1, wherein the two insertion volumes are made in the form of channels, each channel having a channel-shape with a lengthwise axis such that there is a lengthwise axis of a channel-shaped insertion volume for the aluminum conductor and a lengthwise axis of a channel-shaped insertion volume for the contact component.

3. The contact system as in claim 2, characterized in that the channel-shaped insertion volume for the aluminum conductor has a cross section that corresponds in shape to the cross section of the aluminum conductor that is to be accommodated.

4. The contact system of claim 2, wherein the channel-shaped insertion volume for the contact component has a cross section that corresponds in shape to the cross section of the contact component that is to be accommodated.

5. The contact system as in claim 1, wherein the overlapping volume ends in an exit opening that leads from the housing.

6. The contact system as in claim 2, wherein the lengthwise axis of the channel-shaped insertion volume for the aluminum conductor and the lengthwise axis of the channel-shaped insertion volume for the contact component enclose an acute insertion angle.

7. The contact system as in claim 6, wherein an insertion angle is between 1° and 70°.

8. The contact system as in claim 2, wherein the channel-shaped insertion volume for the aluminum conductor has a round or rectangular cross section.

9. The contact system as in claim 2, wherein the channel-shaped insertion volume for the contact component has a rectangular cross section.

10. The contact system as in claim 1, wherein the contact component has a first segment which is made rectangular in lengthwise section, and a second segment, which is made tapered in lengthwise section.

11. The contact system as in claim 1, wherein the contact component has means for contacting by a terminal element.

12. The contact system as in claim 11, wherein the means for contacting are disposed at a first segment of the contact component.

13. The contact system as in claim 12, wherein, in a cold-welded state of aluminum conductor and contact component, the contacting means projects from the housing.

14. The contact system as in claim 1, wherein the contact component is made of copper or a copper alloy with a nickel surface.

15. The contact system as in claim 1, wherein the housing is made of aluminum or an aluminum alloy or a copper alloy with a nickel surface.

16. The contact system as in claim 1, wherein the aluminum conductor is a stranded aluminum conductor.

17. The contact system as in claim 7, wherein the insertion angle is between 1° and 45°.

18. The contact system of claim 10 wherein the second segment immediately adjoins the first segment.

* * * * *